US005915578A

United States Patent [19]

Burt

[11] Patent Number: 5,915,578

[45] **Date of Patent: *Jun. 29, 1999**

[54] CONTAINER CLOSURE AND METHOD OF USE

[76] Inventor: David C. Burt, Star Rte. 154 AH9, Santa Barbara, Calif. 93105

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,276

[22] Filed: Jun. 28, 1996

[51] Int. Cl.[6] ..... B65D 41/20; B65D 53/02

[52] U.S. Cl. ..... 215/250; 215/232; 215/305; 215/349

[58] Field of Search ..... 220/270, 805, 220/666, 675; 215/250, 235, 232, 305, 382, 349, 379

[56] References Cited

U.S. PATENT DOCUMENTS

| | | | |
|---|---|---|---|
| 1,127,357 | 2/1915 | Gavaza | 215/305 |
| 4,811,865 | 3/1989 | Mueller, Jr. et al. | 215/250 X |
| 4,872,571 | 10/1989 | Crecelius | 215/305 X |
| 5,101,870 | 4/1992 | Farris | 215/390 X |
| 5,121,845 | 6/1992 | Blanchard | 215/250 X |
| 5,156,286 | 10/1992 | Piccard | 215/305 X |
| 5,246,126 | 9/1993 | Lewis, Jr. | 215/305 X |

FOREIGN PATENT DOCUMENTS

| | | | |
|---|---|---|---|
| 9313999 | 7/1993 | WIPO | 220/260 |

*Primary Examiner*—Stephen Castellano
*Assistant Examiner*—Niki M. Eloshway
*Attorney, Agent, or Firm*—Leo F. Costello

[57] ABSTRACT

A pull-top closure for a container and a method of using the container incorporating the closure. The container is of the type commonly used for motor oil. It includes a main body having a top wall, a spout projecting upwardly from the top wall adjacent to one side of the body and terminating in a mouth. The top wall slopes from the spout to an upper corner on the opposite side of the body from the spout. The closure includes a seal releasably sealed to the mouth of the spout, a stem connected to the seal on the opposite side thereof from the upper corner and doubled back over the seal so as to extend toward the upper corner, and a ring connected to the stem so that the ring can be extended over the top wall between the spout and the upper corner. With the seal on the mouth of the spout, the container can be grasped around the upper corner between the thumb and middle finger of one hand so that the forefinger can extend over the top wall and be inserted into the ring thereby to hook the ring, and then the container inverted. The spout can then be inserted into the filler opening of an engine or other receptacle and the seal pulled off with the forefinger hooking the ring. This entire procedure can be accomplished with one hand of the user.

11 Claims, 4 Drawing Sheets

CONTAINER CLOSURE AND METHOD OF USE

FIELD OF THE INVENTION

The present invention pertains to a container closure and method of using a container with such a closure and more particularly to a pull-top seal for a container and to a method of pouring the contents from a container which incorporates the seal.

BACKGROUND

A common task in maintaining an engine of a motor vehicle is to fill the engine with oil or other liquids at required intervals. Whether such filling occurs at a service station by the motorist or an attendant, at a garage by a mechanic, or at home or otherwise by the motorist, the method commonly used for many years has remained essentially the same. Oil and other liquids such as transmission fluid are typically sold in quart containers and, at a service station, for example, they are displayed on a rack. A user selects a quart of oil for example, removes both the filler cap and the container cap, and then, in order to dispense the oil, must use some type of funnel.

Previously, the funnel was a tubular extension with a sharp end that penetrated a metal oil can. More recently, with the advent of plastic oil containers, it has been necessary to use a separate funnel. The first case usually required the service attendant to add the oil. In the second case, the motorist usually performs the task if a funnel is readily available.

A funnel is of course necessary because of the inaccessibility of the filler opening in the engine of a motor vehicle. The filler cap is usually surrounded by other engine parts which preclude bringing the spout of an open oil container into direct contact and alignment with the filler cap before the container is inverted. If no funnel is available to a user either at the service station or at home, and the engine requires oil, either the filling task is delayed, to the detriment of the engine, or else much oil is spilled and wasted in an effort to pour some oil into the engine.

Containers with pull tops have been proposed to obviate the need for a funnel, but the known container pull-tops have not been commercially adopted, at least they are not generally seen on the market, perhaps for a variety of reasons. One reason may be that the known pull-tops have been incorporated into the common oil container in such a manner as to require two hands to use, an unnecessary complexity as compared with the present invention. For example, the U.S. Pat. Nos. 4,869,383 to Bahr, et al.; 4,872,571 to Crecelius et al.; 5,121,845 to Blanchard; and 5,156,286 to Piccard each disclose pull-top closures for oil containers of the type discussed in which two hands are required to dispense the oil.

The desirability of using only one hand to dispense liquid from a container having a pull-top closure exists in other applications than just filling an automobile engine with oil and other liquids. Particularly for those with physical disabilities, it may be an advantage to be able to grasp a container with only one hand and, with a finger of that same hand, be able to pull the closure from the opening of the container.

SUMMARY

A pull-top closure for a liquid container and a method of using the container incorporating the closure are provided.

The disclosed embodiment of this invention uses a container of the type commonly used for motor oil. This container includes a main body having a side wall and top and bottom walls connected to the side wall, and an axially offset spout projecting upwardly from the top wall adjacent to one side of the body and terminating in a mouth. The top wall slopes from the spout to the side wall to form an upper corner on the opposite side of the body from the spout. The closure includes a seal releasably sealed to the mouth of the spout, a stem connected to the seal on the opposite side thereof from the upper corner and doubled back over the seal so as to extend toward the upper corner, a ring or other finger engaging portion connected to the stem so that the ring can be extended over the top wall between the spout and the upper corner and hooked by a finger of a user's hand when same hand grasps the container around the upper corner. Such construction allows the container to be grasped around the upper corner between the thumb and middle finger of one hand so that the forefinger can extend over the top wall and be inserted into the ring thereby to hook the ring. With the seal on the mouth of the spout, the container can be grasped, the ring hooked in the manner described, and the container inverted. The spout can then be inserted into the filler opening of an engine or other receptacle and when in place the seal can be pulled off by the forefinger. This entire procedure can be accomplished with one hand of the user.

An object of the present invention is to facilitate opening of a pull-top closure on a container.

Another object is to facilitate removal of a pull-top closure from the mouth of a container when the container is used to dispense liquids into filler openings that are surrounded by other objects which restrict maneuverability of the container adjacent to the filler opening and require that the container be first inverted before bringing the pouring spout of the container into a filling relationship with the filler opening.

A further object is facilitate filling the engine of a motor vehicle with oil and other fluids, Another object is to change, simplify and improve the way a common motor oil or fluid container is used to dispense its contents.

An additional object is to be able to dispense liquids into an engine of a motor vehicle without using a funnel.

A further object is to enable a user to dispense liquid from a container into an engine of a motor vehicle by using only the container and without the need for any accessory device.

Still another object is to enable a container with a pull-top closure to be grasped with one hand for movement into various positions and to be opened with a finger of that same hand while it still grasps the container.

Another object is to locate the pull-top closure on a commonly used type of container so that maximum leverage can be obtained to pull the closure from its sealed position over the mouth of the container while holding the container in one hand of the user and with the use of only this hand.

Yet another object is to facilitate removal of a pull-top closure from a container by those with physical disabilities.

These and other objects, features and advantages of the present invention will become apparent upon reference to the following description, accompanying drawings, and appended claims.

DETAILED DESCRIPTION

Figure 1:
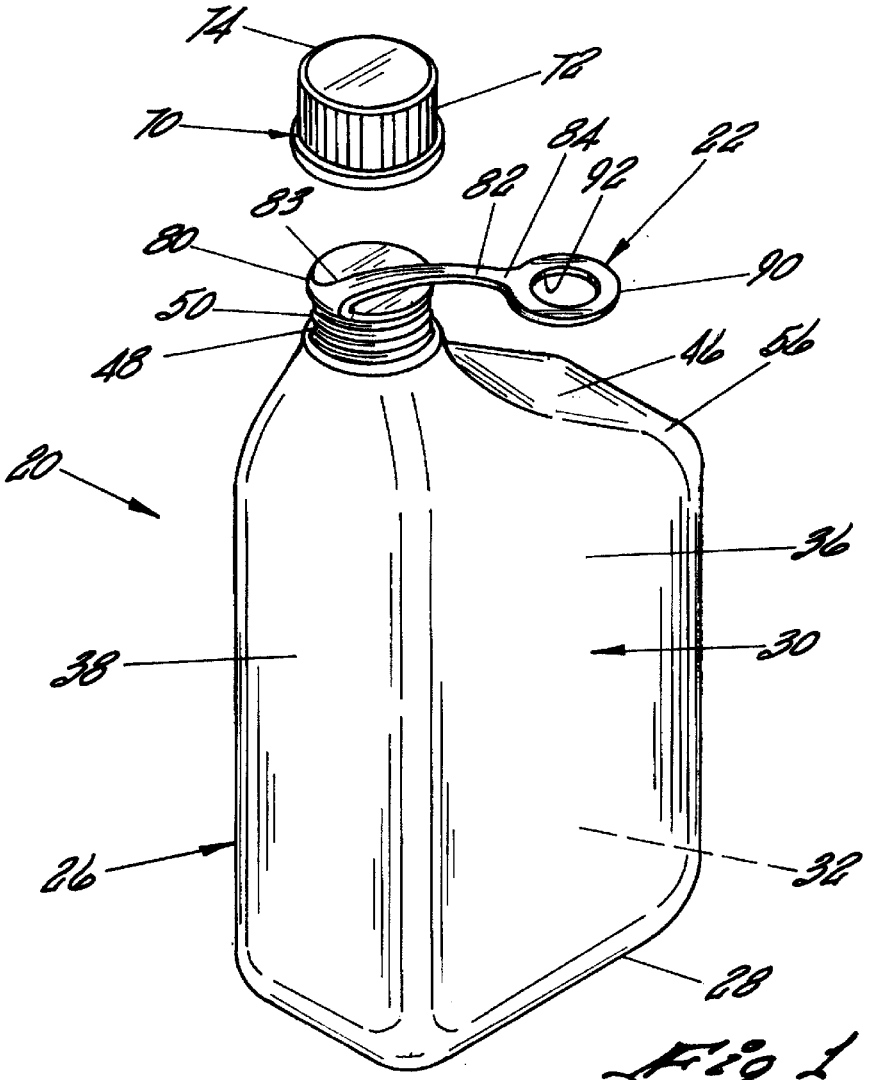
FIG. 1 is an isometric view of an oil container incorporating a pull-top closure in accordance with the present invention with the cap of the container removed to show the closure extending over and slightly downwardly toward the top wall of the container.

With reference to FIG. 1, a container 20 incorporating a pull-top closure 22 is shown. The container shown is a quart container which is in wide usage for the sale and dispensing of motor oil and other fluids for an automobile and is usually placed in racks at service stations for convenient access to customers. Although the present invention is ideally suited for use with this typical container, it will be understood as the description proceeds that the principles of the present invention are adaptable to containers with other shapes but which have features similar to this typical container, as described below.

The container 20 (FIGS. 1, 4, 5, and 8) includes a body 26 having a bottom wall 28 and a side wall 30 upstanding from the bottom wall in circumscribing relation to a chamber 32 within the body for containing oil or other liquid or fluid to be dispensed. The side wall includes a pair of opposed parallel, wide side panels 36; a narrow front panel 38, a narrow rear panel 40 which is parallel to the front panel; and a top wall 46. It is here noted that although the container shown is common, as above described, the reference to "front" and "rear" directions is not common. The reference to the front and rear directions concerns the method in which the container is tipped and inverted which differs from the instructions embossed on a typical quart motor oil container for tipping and inverting the container.

Figures 4, 5:
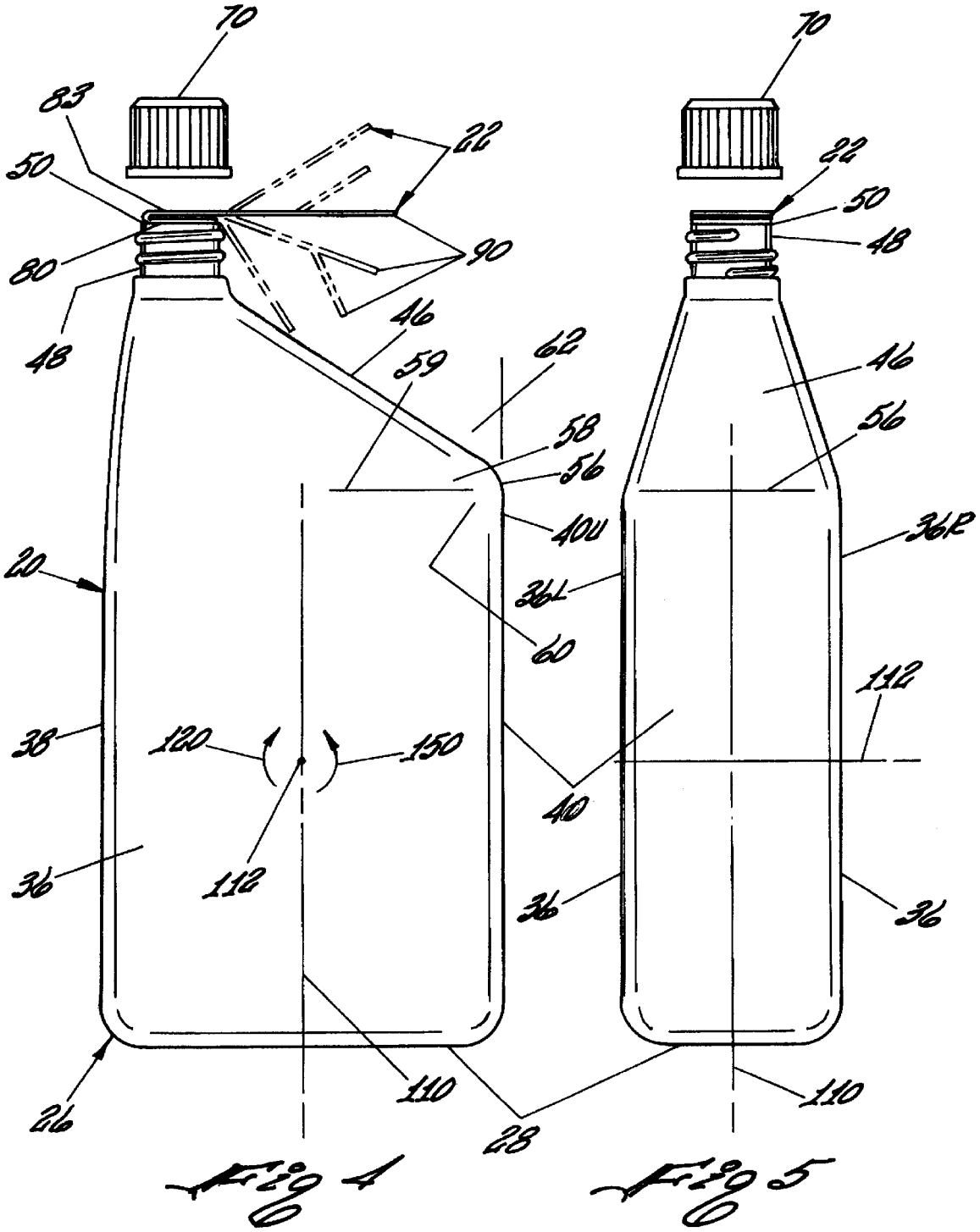
FIG. 4 is an side elevation of the container and closure of FIGS. 1–3, although on a different scale, showing the closure rearwardly extended straight out from the spout.
FIG. 5 is a rear elevation of the container and closure as shown in FIG. 4.

The body 26 (FIGS. 1, 4, 5, and 8) also includes a spout 48 having external threads which projects upwardly from the top wall in offset relation to the center line of the body 26 and terminates in a circular mouth 50. It is noted that in this typical motor oil container, the spout projects from the body in substantial tangential alignment with the front wall, as best seen in FIGS. 1 and 4. The exact amount of offset, or the exact degree of alignment of the spout with the front wall, is not critical to use of the present invention although such offsetting or alignment does facilitate use of this invention as will be seen. Also, it is noted that in the illustrated container, the side panels 36 and the front panel 38 are tapered slightly toward the top wall 46 and the spout 48, respectively. Again, this tapering is not critical to the present invention, but it is a feature found in the typical motor oil container.

The top wall 46 (FIGS. 1, 4, 5, and 8) slopes from the spout 48 to an upper corner or juncture 56 of the body 26 at an angle 58 of approximately twenty-five degrees between the top wall and a line 59 that is horizontal when the container is upright. Also, the top wall 46 joins the rear panel 40 in an obtuse angle 60 internally of the chamber 32 and thus defines complementary exterior acute angle 62. The internal angle 60 is approximately one hundred fifteen degrees in the typical container thereby leaving an exterior angle of approximately sixty-five degrees. The container also includes a circular cap 70 having an internally threaded skirt 72 and a top 74.

Figure 2:
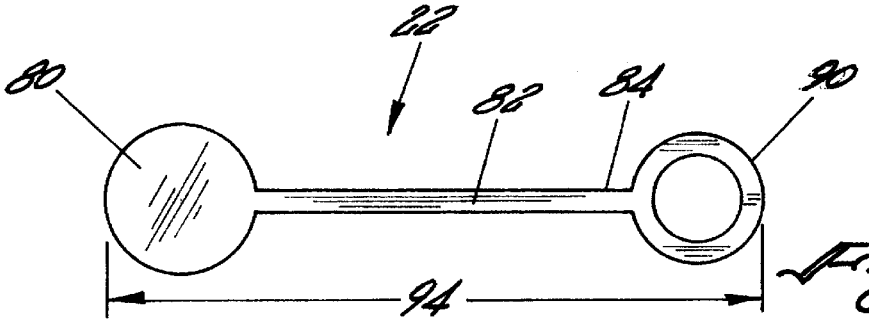
FIG. 2 is a plan view of the closure shown in FIG. 1 but at substantially the same scale as used in accordance with the present invention on a commonly used motor oil container.
Figure 3:
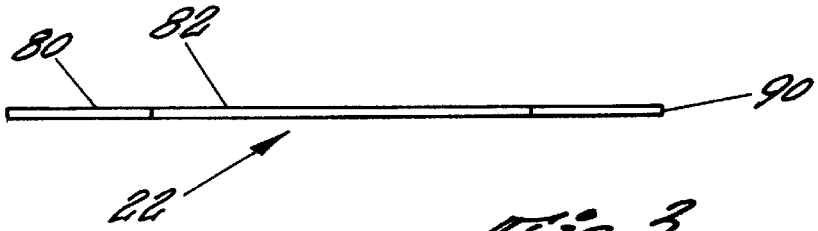
FIG. 3 is an edge view of the closure in FIG. 2.

The pull-top closure 22 (FIGS. 1 through 3), per se, is of well-known material such as metal foil, plastics, paper laminates, or various combinations of such materials. The closure is essentially flexible, although having sufficient body to be self-supporting, in a manner to be described. Also, as is well known, this closure is very thin although in the drawings, such thickness is exaggerated in the scale of the various figures, for illustrative convenience.

Figure 6:
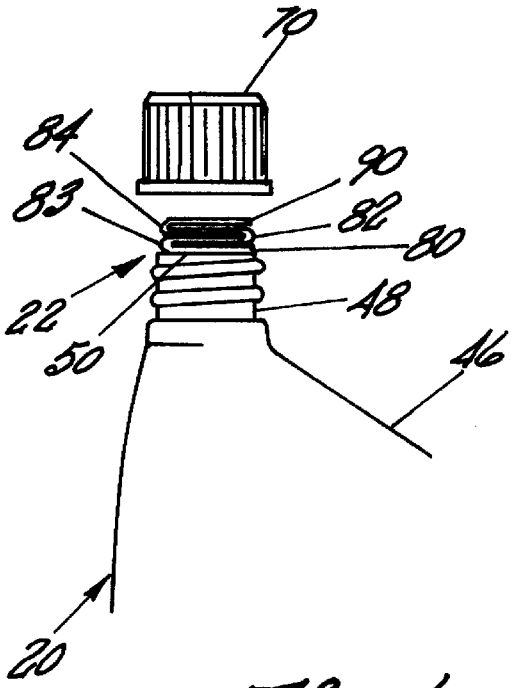
FIG. 6 is a fragmentary detail of the container in FIGS. 4 and 5 with the cap removed to show the closure in its folded position over the spout.

The closure 22 (FIGS. 1 through 3) includes a circular seal 80 having substantially the same diameter as the diameter of the mouth 50 so as to fit over the mouth and be sealed to the spout 48 in a well known manner. The closure also includes an elongated rectangular stem 82 integral with the seal and connected thereto on the opposite side of the spout from the upper corner 56, as illustrated in FIG. 1. The stem is doubled back at 83 from such connection in overlying relation to the seal and includes a rearward end 84 which can be folded against the doubled-back portion (as shown in FIG. 6) or extended rearwardly toward the upper corner 56 and over the top wall 46, as best seen in FIGS. 1, 4, and 8.

Figure 8:
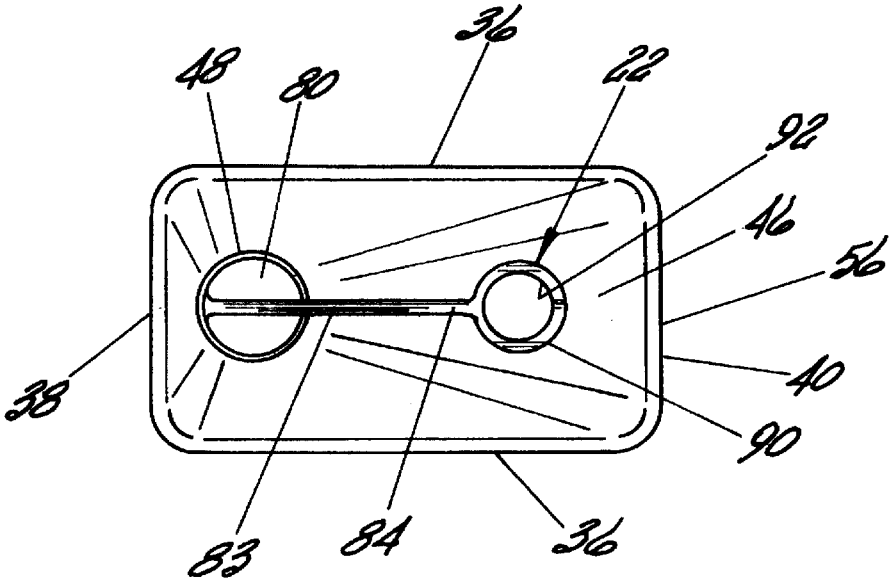
FIG. 8 is a top plan view of the container and closure of FIG. 4 but omitting any showing of the cap.

The closure 22 (FIGS. 1, 2, and 8) also includes a ring or finger-engaging portion 90 integral with the rearward end 84 of the stem 82 and having either a folded position over the doubled-back portion 83 (FIG. 6) or a position in overlying, adjacent spaced relation to the top wall 46 between the spout 48 and the upper corner 56 (FIGS. 1, 4, and 8). The ring has a hole 92 in it which is large enough for the insertion of a finger of a user's hand, as will be seen.

The length 94 of the closure 22 (FIGS. 2 and 3) is such that the ring 90 is restricted from moving rearwardly beyond a position, in the extended condition of the stem 82, which is approximately half-way between the spout 48 and the upper corner 56 (FIG. 4). The precise location of the ring is not critical, but it is important to the convenient use of the container 20 and the pull-top closure 22 that the ring be appropriately positioned, as will be discussed, between the spout and the corner when the stem extends rearwardly, as shown in FIGS. 1, 4, and 8. In the preferred embodiment, the closure's overall length 94 is approximately 3⅜ inches to 3⅝ inches when used with a typical one-quart oil container, as discussed above.

As noted above, the closure 22 (FIGS. 1 and 4) preferably has sufficient body so that the stem 82 is able to support the ring 90 in adjacent, opposed, spaced relation to the top wall 56 when the rearward end is pointing rearwardly and the ring is over the top wall. In other words, as best illustrated in FIGS. 1 and 4, when the rearward end 84 is pointing rearwardly, the rearward end and the ring 90 should be supported outwardly, as illustrated, rather than being allowed to slump against the spout 48 and forward end of the top wall 46. With the closure 22 made of metal foil, for example, this support is inherent in the material. Moreover, metal foil also allows the rearward end to be bent upwardly and downwardly from the doubled-back portion 83, as shown in FIG. 4, and the ring 90 to be bent upwardly and downwardly from the rearward end 84, as also illustrated in FIG. 4. Thus, the stem allows the user to adjust the location of the hole 92 in the ring so that it is most convenient for insertion of the user's finger in the manner to be described. Also, the closure must have enough "memory" in the material used that when the stem is bent into one of the positions shown, it will remain in essentially the same position unless again manually changed.

Figure 7:
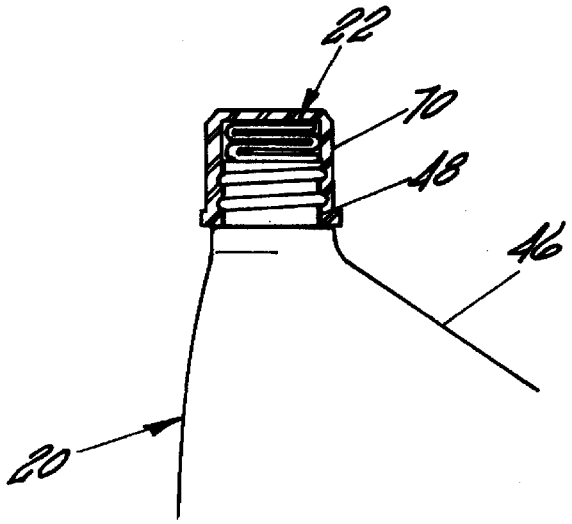
FIG. 7 is a fragmentary detail similar to FIG. 6 but showing the cap on the spout sandwiching the closure between the cap and the spout.

It is noted that the material of the stem 82 must allow for doubling back of the stem from its connection to the seal 80 so that the rearward end 84 points rearwardly in the extended position of the stem. At the same time, the stem must be sufficiently flexible to allow the stem to be moved into its folded position, as shown in FIG. 6, wherein the doubled-back portion 83 overlies the seal, the rearward end 84 overlies the doubled-back portion, and the ring 90 overlies the rearward end so that the entire closure is within the diameter of the mouth 50. Such folded position allows the cap 70 to be threaded onto the spout 48, as illustrated in FIG. 7.

METHOD OF USE

The method of using the preferred embodiment of the container 20 and the pull-top closure 22 is conveniently described with reference to an engine 100 (FIG. 9), such as that in a motor vehicle, having a filler opening 102 for receiving oil or other fluids. Before describing how the subject container is used to pour oil into the filler opening, it will be helpful to identify further various parts of the container. Thus, the two side panels 36 (FIGS. 4 and 5) and the rear panel 40 have corner portions 36L, 36R, and 40U each of which is generally adjacent to the upper corner 56. Also, the container has a longitudinal axis 110 generally parallel to the spout 48 and centrally located between the side, front, and rear panels 36, 38, and 40 and a transverse axis 112 extending generally centrally through the side panels between the top and bottom walls 46 and 28.

It is here noted that the commonly accepted direction for tilting a conventional quart motor-oil container is in the direction of the arrow 120 (FIG. 4) about the transverse axis 112; this direction of rotation or tipping is often embossed on a conventional quart motor-oil container near the spout. It is also the direction for tilting suggested in all of the patents first mentioned above where this typical shape of motor oil container is used. As will be described below, this is not the direction of rotation or tipping utilized in carrying out the method of the present invention, and in fact, the subject invention renders this recommended conventional direction of rotation obsolete.

Figure 9:
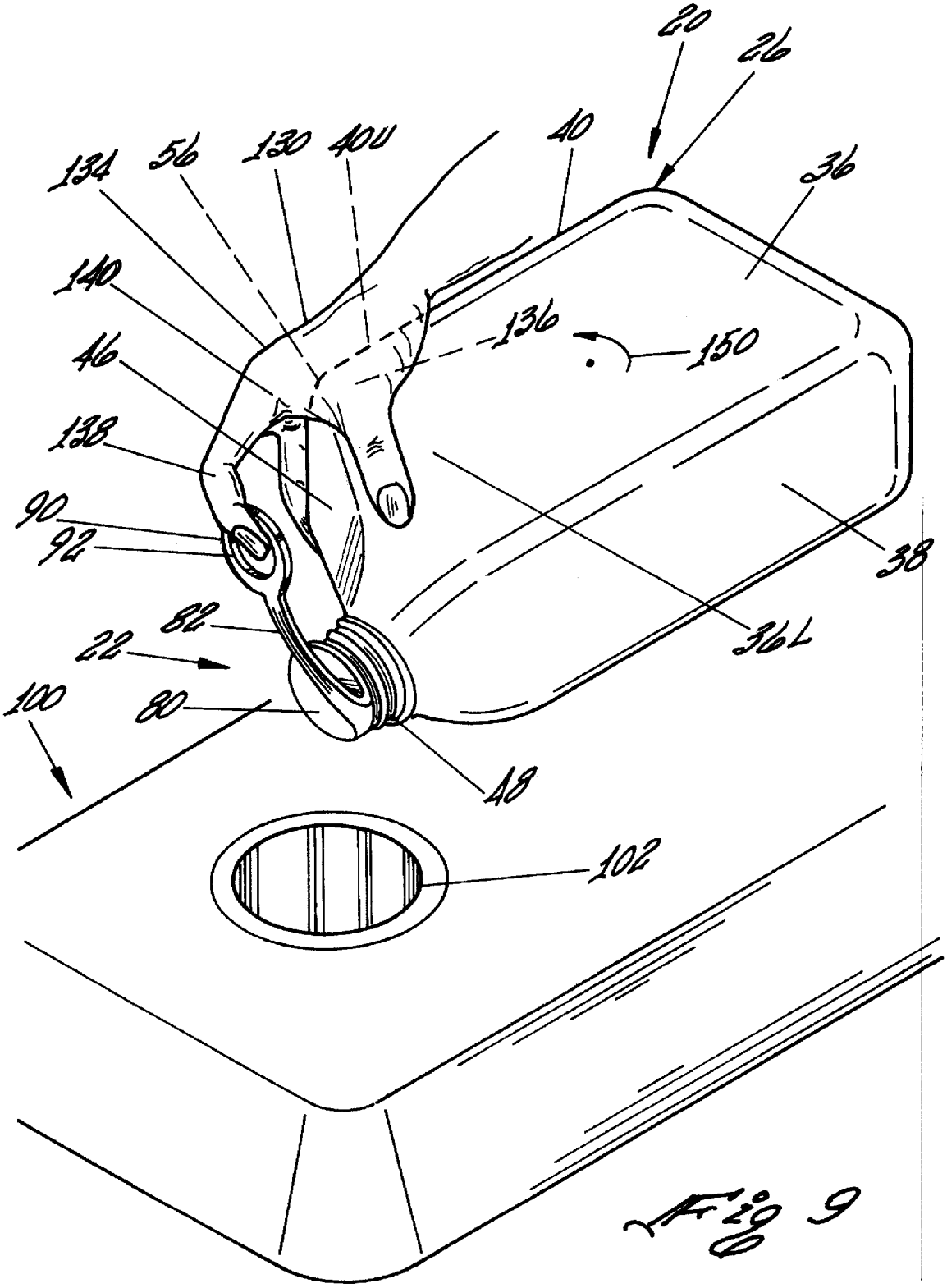
FIG. 9 is an isometric view of the container and pull-top closure, on a scale different from the other Figs., showing the container in use just prior to insertion of the spout into the filler opening of a motor vehicle and removal of the closure from the spout, all by one hand of the user.

With reference to FIG. 9, the method according to the present invention to pour liquid from the spout 48 of the container 20 is now described. Initially, the user selects a quart of motor oil in a container, as 20, and removes the cap 70. The closure 22 is lifted and the ring 90 is gently pulled rearwardly until it overlies the top wall 46. In addition, the stem 82 and ring 90 are bent into an attitude so that the hole 92 will be conveniently positioned for insertion of the user's finger.

The container 20 (FIG. 9) is then grasped by one hand 130 of the user by holding the corner portions 36L and 36R between the thumb 132 and middle finger 134 of the hand and with the palm 136 of the hand against the corner portion 40U of the rear panel 40. With the container thus grasped in the hand, the forefinger 138 extends over the top wall 46 and can pivot about the knuckle 140 of the forefinger throughout substantially the full exterior angle 62 (FIG. 4). With the ring 90 (FIG. 9) in the above-described extended position over the top wall, the forefinger is inserted into the hole 92 so as to hook the ring by the forefinger.

With the container 20 (FIG. 9) grasped in the hand 130 and with the forefinger 138 hooking the ring 90, the container is tilted in the direction of the arrow 150 and placed in an upside-down inverted position, or nearly so, so that the container can be moved down into the engine 100 to bring the spout 48 into alignment with the filler opening 102 and eventually to insert the spout into the filler opening. With the spout in the filler opening, the ring is pulled rearwardly by the forefinger 138 to pull the seal 80 off the mouth 50 of the spout 48 and to allow the oil, or other liquid, to flow into the engine. It is desirable to have the forefinger continue to be hooked into the ring as the oil is flowing out and until the container is completely empty to prevent the closure 22 from accidentally falling into the engine. Alternatively, the seal need not be completely removed from the mouth to allow the oil to flow out. It may be completely removed unintentionally, however, so that being able to hold onto the ring will prevent the entire closure 22 from falling down and perhaps entering the filler opening 100.

Several advantages of this method of use should be noted. First, and as has been emphasized, the entire operation can be accomplished with the single hand of a user. In this manner, the other hand can be used to balance the user against the vehicle and thus to help guide the spout 48 into exact alignment with the filler opening 102, especially when such opening is more difficult to reach in the engine and especially if the engine is hot. This is in contrast with prior art containers and pull-top closures which require two hands to operate, namely, one hand to hold the container and the other hand to pull on the closure.

It will be understood that pulling the stem 82 and ring 90 (FIG. 9) over the sloped top wall 46 which is at an obtuse angle 60 at the corner 56, as contrasted with pulling them over a top wall which is at a ninety-degree angle at the corner, provides better entrance into the ring and leverage for the finger, as 138, to engage the ring 90 and pull it rearwardly to remove the seal 80 from the mouth 50. Pulling over a right-angle corner has one of two adverse effects: first, if the container is grasped between the thumb 132 and the middle finger 134 relatively low on the corner portions 36L, 36R, and 40U, the forefinger contacts the corner and impedes full pivoting action of the forefinger; secondly, if the container is grasped higher around these corner portions to place the knuckle 140 immediately over the corner, then the forefinger is not in a position to be inserted as easily into the hole 92 nor is there sufficient room beneath the forefinger to conveniently pull the ring rearwardly. Thus, the subject closure cooperates with the slope of the top wall 46 is a very advantageous manner.

Another advantage of the subject method is that tilting the container 20 in the direction of the arrow 150 (FIG. 9) immediately places the spout 48 at the lowest point of the inverted or inverting container so that it can be more easily and directly guided by the user's hand 130 toward the filler opening 102. With the conventionally prescribed method of inversion, in the direction of the arrow 120 (FIG. 4), the corner 56 is at the lowest point when the tilting or inverting action begins and thus tends to contact other adjacent engine parts and prevent the direct movement of the spout toward and into the filler opening. Furthermore, tilting the container in the direction of the arrow 150, makes it easier to empty the container completely and more quickly since the flow surface is along the straight front panel 40, as contracted with along the top wall 46 as is presently done. The container can thus be emptied completely without having to invert the container into a fully vertical, or even slightly beyond vertical, attitude.

Although the subject invention has been described with reference to the commonly used quart motor-oil container, as 20, it will be understood that the principles of the present invention are applicable to containers having similar characteristics for holding other kinds of liquids where one-hand dispensing is desirable. This is especially the case where the person using the container has a physical disability or prefers to use the free hand for some other purpose while tilting and opening the container with one hand. As has been stated and is believed, with the conventional pull-top closure, it is necessary to use two hands to remove the closure, one hand to hold the container stable and the other hand to grasp the pull-top closure and remove it. With the present invention, the hand that grasps the container provides the necessary stability, and the finger in engagement with the ring, located as illustrated and described, provides the necessary leverage to remove the seal, as 80, from the mouth, as 50, of the container. Of course, another advantage of the present invention is that the pouring action and the seal-removing action can be essentially accomplished in one step, or a series of steps which are part of one overall action.

Although a preferred embodiment of the present invention has been shown and described, various modifications, substitutions and equivalents may be used therein without departing from the spirit and scope of the invention. Accordingly, it is to be understood that the present invention has been described by way of illustration and not limitation.

What is claimed is:

1. A liquid container and pull-top closure combination wherein the closure can be removed from the container using only a finger of the hand that holds the container, the container including a main body having a side wall with opposed front and rear panels and opposed side panels and surrounding a longitudinal axis for the container, the container also having top and bottom walls connected to the side wall thereby defining a chamber for container liquid, the container further having a spout projecting upwardly from the top wall in offset relation to said axis and terminating in a mouth, the plane of the front panel being substantially tangential to the spout, said spout having a length measured from the mouth to the top wall, the top wall thereby extending from the spout to the rear panel and forming therewith an upper shoulder on the opposite side of the spout from the front panel, said top wall having a length measured from the spout to the upper shoulder, the closure including a seal having front and rear edges, a stem having front and rear ends, and a ring having front and rear edges, the seal being releasably sealed to the mouth of the spout with its front edge disposed toward the front panel and its rear edge disposed toward the rear panel, the front end of the stem being connected to the front edge of the seal, the front edge of the ring being connected to the rear end of the stem, the length of the stem and the ring together from the front end of the stem to the rear edge of the ring being such that with the seal in fully sealed relation to the spout and the stem and ring fully stretched out, the stem can be extended rearwardly over the seal and out over the top wall and the ring can be positioned over the top wall between the spout and the upper shoulder with the front edge of the ring in rearwardly spaced relation to the spout and the rear edge of the ring in forwardly spaced relation to the upper shoulder.

2. The container and closure of claim 1, wherein the stem supports the ring in adjacent spaced relation to the top wall to facilitate interconnection of a user's finger with the ring and to allow the finger to move toward and away from the top wall.

3. The container and closure of claim 1, wherein the top wall slopes downwardly from the spout to the upper shoulder, wherein the stem is bendable relative to the seal while the seal remains sealed on said mouth, and wherein the ring is bendable relative to the stem whereby the stem and the ring can be moved together in coplanar relation above and below a position of parallelism with the top wall and whereby the plane of the ring can be moved relative to the plane of the stem, thereby enabling the hole to face more toward the top wall or more toward the upper shoulder which, together with the slope of the top wall, facilitates insertion of said finger into said ring and consequent leverage of the finger in pulling the seal off from the mouth.

4. The container and closure of claim 1, wherein the length of the closure from the rear edge of the seal to the rear edge of the ring is between about three and three-eighths inches and about three and five-eighths inches.

5. The container and closure of claim 1, wherein when the seal is in fully sealing relation with the mouth of the spout, the stem is flexibly moveable about the rear edge of the seal between a position with the ring contacting the top wall while the seal remains fully sealed over the spout and various positions with the ring spaced over the top wall.

6. The container and closure of claim 1, wherein the stem and the ring together constitute a pull tab and wherein said length of the stem and ring together is greater than one-half said length of the top wall but less than said length of the top wall, and wherein the stem is connected to the seal for flexing movement of the pull tab while the seal remains in fully sealed relation to the mouth of the spout, so that the ring can be moved toward and away from the top wall and is restricted from moving closer to the upper shoulder while the seal remains in said fully sealed relationship.

7. The container and closure of claim 1, wherein the combined length of the rear stem and the ring from the rear edge of the seal to the rear edge of the ring is from about one and three-eighths inch to about one and five-eighths inch when the seal is in its fully sealed relation to the spout and when the stem and the ring are fully stretched rearwardly from the spout.

8. The container and closure of claim 1, wherein the top wall is sloped from the spout to the upper shoulder, and wherein the slope of the top wall is defined by an angle of approximately twenty-five degrees between the top wall and a horizontal plane.

9. A container and closure combination capable of being opened with only one hand while said hand grasps the container and a finger of such hand connects to the closure comprising:

a container having a bottom panel, a pair of opposed wide side panels connected to and upstanding from the bottom panel, opposed narrow front and rear panels connected to and upstanding from the bottom panel and also connected to their respectively adjacent side panels thereby to define a chamber, a sloping top panel connected to the rear panel at an upper rear corner which has an included obtuse angle of approximately one hundred fifteen degrees within the chamber, said container having a longitudinal axis that extends from the bottom wall to the top panel intermediate the front and rear panels, and a front spout extending upwardly from the top panel in substantial tangential alignment with the front panel, said spout communicating with the interior of the container and terminating in a mouth having front and rear edges respectively disposed toward the front and rear panels, said spout having a length equal to the distance from the mouth to the top panel;

a flexible closure including a seal releasably secured over the mouth and having front and rear edges adjacent to the front and rear edges respectively of the mouth, a stem flexibly connected to the front edge of the seal, doubled back thereover and extending over the top panel in spaced relation thereto and terminating in a rearward end, and a ring having a front edge connected to the rearward end of the stem, the length of the stem and ring together when the stem and the ring are fully stretched out from the seal being greater than the length of the spout but less than the length of the top panel, said ring being positioned in a finger-connecting position over the top panel between the spout and the upper corner at about the location of said axis and with its front edge spaced rearwardly of the spout while the seal remains fully sealed over the mouth, said stem being flexible but having sufficient rigidity to maintain the ring in said finger-connecting position so that by grasping the side panels between the thumb and middle finger with the palm of the hand engaging the rear panel, the container can be tipped forwardly and inverted with the spout pointing downwardly below the upper corner and so that by extending the forefinger of said hand over the top panel and through the ring, the seal can be pulled off the spout by a rearward and downward pull on the ring, thereby to open the mouth and discharge the contents of the chamber with one hand.

10. The container and closure of claim 9, wherein the length of the closure when fully rearwardly extended from the spout along a line tangentially related to the spout and the upper rear corner and while the seal is fully sealed on the spout is less than the distance between the mouth and the upper corner but greater than about one-third said distance.

11. The container and closure of claim 10, wherein the length of the stem is such as to allow the stem to be first doubled back on the seal and then doubled back on itself in overlying relation to the mouth, wherein the ring can be doubled back on the stem in overlying relation to the stem and the mouth, and wherein the container includes a cap having a skirt and a top, said cap being releasably connected to the spout with the skirt circumscribing the spout and with the doubled back stem and ring being sandwiched between the mouth and the top of the cap.

* * * * *